US010365059B2

(12) United States Patent
Sroufe et al.

(10) Patent No.: US 10,365,059 B2
(45) Date of Patent: Jul. 30, 2019

(54) FIREARM HAVING A REMOVABLE STRIKER HOUSING

(71) Applicant: Taurus International Manufacturing, Inc., Miami, FL (US)

(72) Inventors: Dustin Sroufe, Hollywood, FL (US); Jesse Peyton, Plantation, FL (US); Kathryn Hack, Farmington, NH (US); Robert Miller, Brambleton, VA (US)

(73) Assignee: Taurus International Manufacturing, Inc., Miami, FL (US)

( * ) Notice: Subject to any disclaimer, the term of this patent is extended or adjusted under 35 U.S.C. 154(b) by 0 days.

(21) Appl. No.: 15/789,527

(22) Filed: Oct. 20, 2017

(65) Prior Publication Data

US 2018/0112945 A1 Apr. 26, 2018

Related U.S. Application Data

(60) Provisional application No. 62/411,195, filed on Oct. 21, 2016.

(51) Int. Cl.

| | |
|---|---|
| ***F41A 19/30*** | (2006.01) |
| ***F41A 3/72*** | (2006.01) |
| ***F41A 3/66*** | (2006.01) |
| ***F41C 3/00*** | (2006.01) |
| ***F41A 11/00*** | (2006.01) |

(52) U.S. Cl.

CPC ..... *F41A 19/30* (2013.01); *F41A 3/66* (2013.01); *F41A 3/72* (2013.01); *F41A 11/00* (2013.01); *F41C 3/00* (2013.01)

(58) Field of Classification Search

CPC .... F41A 19/30; F41A 3/66; F41A 3/72; F41A 3/00

USPC ..... 89/196, 195, 194; 42/16

See application file for complete search history.

(56) References Cited

U.S. PATENT DOCUMENTS

| | | | | | |
|---|---|---|---|---|---|
| 956,431 | A * | 4/1910 | Schmeisser | F41A 19/30 | 42/1.04 |
| 989,432 | A * | 4/1911 | Schmeisser | F41A 3/86 | 42/75.02 |
| 1,386,197 | A * | 8/1921 | Ortgies | F41A 11/00 | 42/7 |
| 1,680,186 | A * | 8/1928 | Von Frommer | F41A 3/66 | 42/106 |
| 3,707,794 | A * | 1/1973 | Rocha | F41A 19/39 | 42/1.08 |
| 3,728,939 | A * | 4/1973 | Wilhelm | F41A 3/64 | 42/75.01 |
| 5,581,046 | A * | 12/1996 | Weldle | F41A 3/86 | 89/163 |
| 6,513,273 | B2 * | 2/2003 | da Silveira | F41A 17/02 | 42/16 |

(Continued)

*Primary Examiner* — Joshua E Freeman

(74) *Attorney, Agent, or Firm* — DeLio Peterson & Curcio LLC; Robert Curcio

(57) ABSTRACT

A pistol having a pistol slide with apertures for receiving finger grips. The finger grips have an attachment scheme for slideably securing a striker housing inside the pistol slide. The striker housing retains a striker and a striker block, such that intricate machining is no longer required on the interior portions of the pistol slide to hold the striker or striker block. The striker housing has a planar protuberance that forms a ridge for being slidably received by corresponding wedges on the finger grip interior portion.

11 Claims, 7 Drawing Sheets

(56) References Cited

U.S. PATENT DOCUMENTS

| | | | | |
|---|---|---|---|---|
| 6,571,501 | B1 * | 6/2003 | Jennings | F41A 3/66 42/70.02 |
| 8,065,950 | B2 * | 11/2011 | Kaminsky | F41A 5/20 89/171 |
| 8,739,445 | B2 * | 6/2014 | Burke | F41A 11/02 42/16 |
| 8,931,394 | B2 * | 1/2015 | Bryant | F41A 5/02 42/1.06 |
| 9,021,730 | B2 * | 5/2015 | Gentilini | F41A 3/12 42/16 |
| 9,777,980 | B2 * | 10/2017 | Heizer | F41A 3/86 |
| 9,970,726 | B1 * | 5/2018 | Hubert | F41A 17/64 |
| 2011/0088539 | A1 * | 4/2011 | Oz | F41A 19/34 89/1.4 |
| 2012/0198744 | A1 * | 8/2012 | Meller | F41A 3/72 42/90 |
| 2012/0317856 | A1 * | 12/2012 | Burke | F41A 11/02 42/16 |
| 2016/0061562 | A1 * | 3/2016 | Braun | F41A 3/72 42/111 |
| 2016/0102938 | A1 * | 4/2016 | Sroufe | F41A 3/72 42/16 |

* cited by examiner

FIREARM HAVING A REMOVABLE STRIKER HOUSING

BACKGROUND OF THE INVENTION

1. Field of the Invention

The present invention relates to firearms, specifically to a handheld firearm, such as a striker fired pistol, and more specifically to a pistol having a slide with an inner striker housing for securing a striker and striker block, the striker housing being slidably attachable to finger grips that are held in place by the pistol slide. The inner striker housing eliminates the need for intricate machining or molding of the pistol slide interior. It can be removably attached, which assists in replacement and/or cleaning.

2. Description of Related Art

Firearms such as semi-automatic pistols generally include a number of common components, such as a frame, a barrel that defines a chamber for holding a cartridge, a reciprocating slide that defines a breech face for engaging the rear of the chamber; and a spring-loaded axially-movable firing pin (the "striker") disposed in the slide and, upon firing, contacts the cartridge to discharge the pistol. A striker-fired pistol has a firing control mechanism that eliminates the hammer and operates by directly cocking and releasing the firing pin or striker.

Due to their lack of a protruding hammer, many striker fired pistol designs have popularized the concealed carry market. Striker fired pistol designs also ensure that each trigger pull from the first through the final round of the magazine has the same weight of pull.

A striker is a heavy firing pin that acts as both a firing pin and a hammer. It has enough mass to set off a primer, but it doesn't look like a hammer. In fact, most strikers look like wide firing pins. The firing pins on most bolt-action rifles are actually either strikers by themselves, or they are attached to extra mass and then function as strikers. Typically, the striker firing mechanism uses a spring-loaded firing pin or rod segment that works more like the launcher in a pinball machine than that of a traditional pistol with a hammer. This spring-loaded pin is partially cocked by the movement of the slide. The trigger then cocks the pin the remainder of the way and releases it to strike the primer and ignite the cartridge.

With either center- or rim-fire type of ammunition, the rear of the casing must be struck with enough force to ignite the primer, which then catalyzes the gunpowder explosion to propel the bullet from the cartridge through the gun barrel. In striker-fired pistols, the striker is the component that strikes the casing and ignites the primer.

As the trigger is pulled the striker is moved rearward within the pistol. This increases the tension on the firing pin spring. When the trigger bar releases the firing pin lug, the striker moves forward as the firing pin spring relaxes. This motion causes the striker to impact the ammunition in the chamber.

The slide is the part of the pistol that moves during the operating cycle and generally houses the firing pin or striker, striker block, and an extractor, and serves as the bolt. It is spring-loaded so that once it has moved to its rearmost position in the firing cycle; spring tension brings it back to the starting position chambering a fresh cartridge during the motion, provided that the magazine is not empty.

The slide contains a barrel and a breech and is guided in the longitudinal direction with respect to the housing. With the aim of making pistols as light as possible, many manufacturers have endeavored to make as many parts as possible from plastic. In striker fired pistols, the striker and striker block are housed in the slide. This requires intricate machining on the inside of the slide in order to secure properly these components. This intricate machining increases manufacturing time and cost, and may introduce inaccuracies due to manufacturing tolerances. Additionally, cleaning this intricate machining remains a difficult task.

SUMMARY OF THE INVENTION

Bearing in mind the problems and deficiencies of the prior art, it is therefore an object of the present invention to provide a striker fired pistol having striker mechanism and striker block that are incorporated in a separate housing that is then slidably inserted into the slide, such that intricate machining on the inside of the slide is no longer required.

It is another object of the present invention to provide a striker housing for a striker fired pistol that is at least in part secured to the slide via externally attached finger grips.

The above and other objects, which will be apparent to those skilled in the art, are achieved in the present invention which is directed, in a first aspect, to a firearm comprising: a frame with a magazine receiving grip and a trigger firing mechanism; a barrel having an internal axial bore, a breech end, a muzzle end, and a cartridge receiving aperture; a slide having an interior, a breech end, a muzzle end having an aperture for exposing the bore of the barrel, and a longitudinal axis parallel to the barrel, the slide enclosing at least a portion of the barrel when the firearm is in a cocked position, the slide being slidably movable along the longitudinal axis with respect to the frame; an insertable, removable striker housing having an aft end and a forward end, and opposing lateral sides, the striker housing including a striker and a striker block responsive to the trigger firing mechanism of the firearm, the striker housing insertably held within the slide interior, such that the striker housing forward end is proximate the barrel breech end when the striker housing is installed in the slide.

The slide has opposing lateral sides parallel, and adjacent, to the striker housing opposing lateral sides, wherein at least one of the slide's opposing lateral sides includes an aperture or through-hole for receiving a removable finger grip.

In at least one embodiment, the striker housing includes a first attachment member on at least one of the striker housing opposing lateral sides for securing to a complementary second attachment member on a corresponding removable finger grip when the striker housing is inserted within the slide, and the corresponding removable finger grip is inserted within the aperture or through-hole of an adjacent lateral side of the slide.

The first attachment member on the striker housing may comprise a planar protuberance on the at least one striker housing opposing lateral side, extending longitudinally along the at least one striker housing opposing lateral side, and forming a ridge or gap along at least one edge with the at least one striker housing opposing lateral side.

The second attachment member is configured to receive the planar protuberance, and may comprise at least one wedge portion to slidably insert within the ridge or gap formed on the planar protuberance.

It is also noted that an attachment member may include an indentation and/or and extension on either the striker housing lateral side, on the finger grip inside surface, or both, to perform a snap-fit, a friction fit, or an interlocking attachment formed by the compression of resilient members into complementary receiving slots.

In another embodiment, the finger grip may include a resilient circumferential ridge that encompasses a circumferential lip around the opposing lateral side aperture or through-hole, or vice-versa, for a compression fit attachment to the slide.

In a second aspect, the present invention is directed to a pistol comprising: a frame having a front end, a rear end, laterally spaced side walls, a hand grip with a chamber therein for receiving a magazine, a firing mechanism fitted into the frame, a barrel having a breech end and a muzzle end, and a slide having an apertured front wall, a rear wall, laterally spaced side walls disposed in vertically spaced relation to the frame, each of the slide's laterally spaced side walls having an aperture for receiving a detachable finger grip; an insertable, detachable striker housing having an aft end and a forward end, and opposing lateral sides, the striker housing retaining a striker and a striker block, the striker housing insertably held within the slide, such that the striker housing forward end is proximate the breech end of the barrel; each of the slide's laterally spaced side walls includes an aperture or through-hole for receiving the detachable finger grip; and the striker housing includes a first attachment member on each of the striker housing's opposing lateral sides for securing to a complementary second attachment member on each corresponding detachable finger grip when the striker housing is inserted within the slide, and each corresponding detachable finger grip is inserted within the aperture or through-hole of the adjacent laterally spaced sidewall of the slide.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-6 of the drawings in which like numerals refer to like features of the invention.

Figure 1:
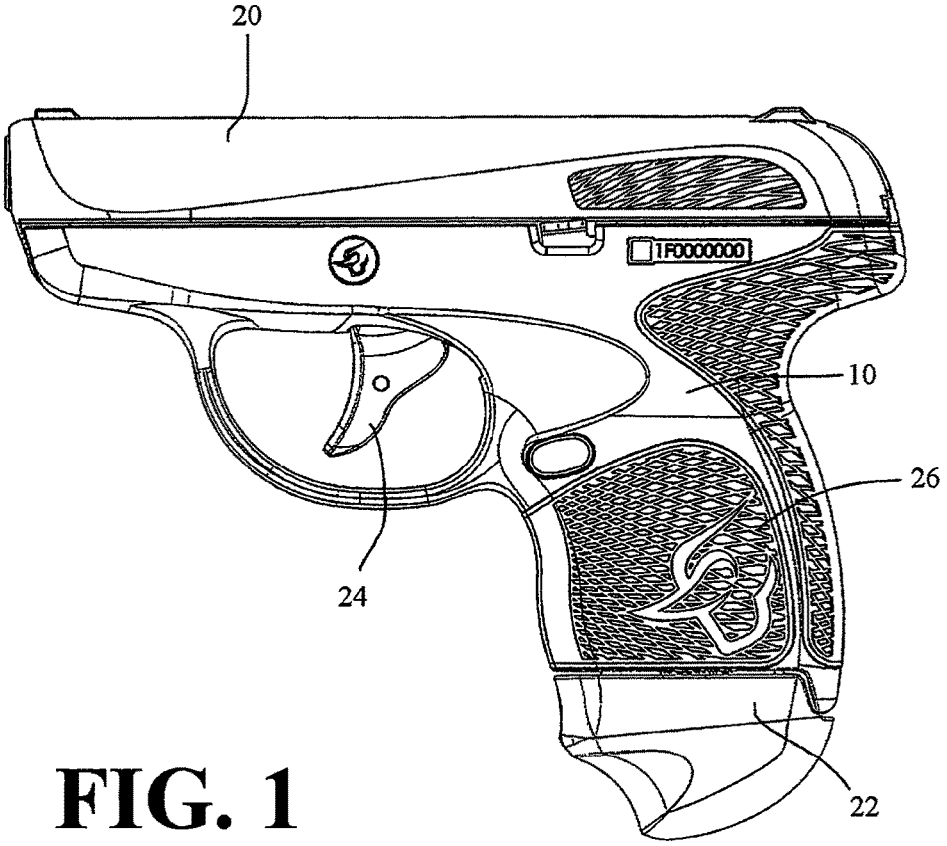
FIG. 1 is a side view of a pistol of the present invention having a striker housing within the pistol slide for securing a striker and a striker block, and finger grips on the slide for securing the striker housing within the slide, and facilitating the racking of the slide.

FIG. 1 is a side view of a pistol of the present invention having a striker housing within the pistol slide for securing a striker and a striker block, and finger grips for facilitating the racking of the slide while providing structural support for holding the striker housing. Referring to FIG. 1, the semi-automatic pistol includes, among many other components, a generally high impact polymeric frame 10, a firing mechanism which includes a striker housing 14 (not shown) containing a striker 16 and a striker block 18, a slide 20, and a removably insertable magazine having a base portion 22. The firing mechanism further includes a pivotable trigger 24 that displaces a sear (not shown), which in turn causes the sear to disengage from the striker, discharging the pistol.

A striker-fired pistol works without a standard hammer or firing pin. Instead, the firing pin or striker sits captive under spring tension inside the slide when the pistol is not being put through the firing process. The striker is usually prevented from moving forward towards the primer of the chambered round by safeties, such as a striker block. The striker is cocked when the slide is racked. On a typical striker-fired pistol, the only way to de-cock is to pull the trigger.

The striker block is a mechanical block used in semi-automatic firearms and some revolvers that, when at rest, obstructs forward travel of the firing pin or striker, but is linked to the trigger mechanism and generally designed to clear just before the striker is released. This prevents the firing pin or striker from striking a chambered cartridge unless the trigger is pulled, even if, for example, a faulty sear causes an inadvertent release.

The slide 20 includes a distal or muzzle end face having an aperture for exposing the bore of a barrel. The slide's muzzle end face aperture together with the barrel permit the egress of a round of ammunition. The magazine is received within the handle or grip portion 26 of frame 10. A firing mechanism is mounted in the frame 10 and includes a spring activated striker-firing pin mechanism. Movement of the trigger 24 causes a pivotally connected trigger bar to move laterally within the frame 10 and actuate the sear.

Figure 2A:
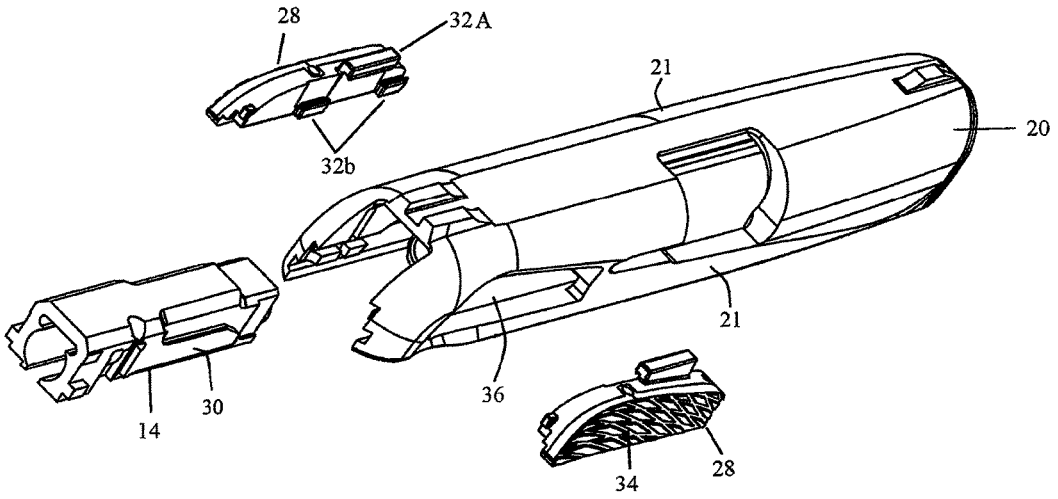
FIG. 2A is an exploded view from the breech end of the pistol slide depicting attachable finger grips and striker housing.

FIG. 2A is an exploded view from the breech end of the pistol slide 20 with removably attached finger grips 28 and striker housing 14. Striker housing 14 is preferably comprised of a polymer (plastic) material, although other materials suitable for firearms may be employed. The inner surfaces of striker housing 14 include intricate segments, gaps, and ridges for supporting a striker and a striker block. By utilizing the removably attachable striker housing 14 in this manner, the inside surfaces of the slide are no longer required to have complementary mating segments, gaps, and/or ridges to hold the striker or the striker block, since these components are now secured within the removable, detachable striker housing 14.

Figure 2B:
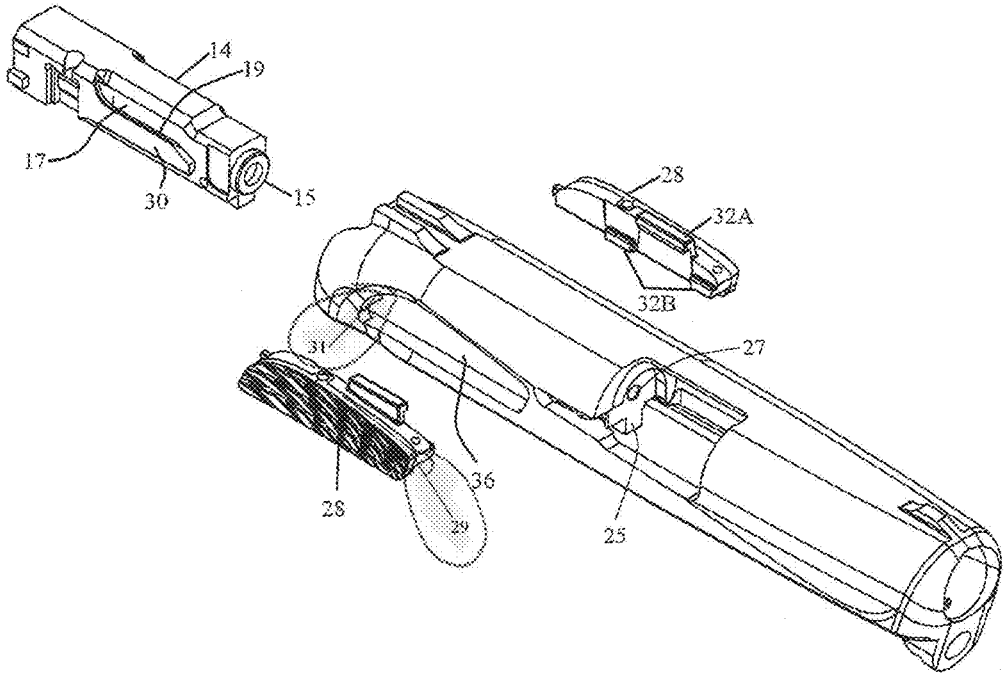
FIG. 2B is an exploded view from the muzzle end of the pistol slide of FIG. 2A.

FIG. 2B is an exploded view from the muzzle end of pistol slide 20. Striker housing 14 includes an aperture 15 at its forward end allowing for movement of the striker during firing for engaging a cartridge loaded in the barrel chamber. A breech face 26 is located between the breech end of the slide and the muzzle end of the slide. Breech face 25 includes an aperture 27 to allow movement of the striker towards the cartridge primer.

As shown in an exemplary embodiment, the striker housing includes opposing lateral sides 17 facing outwardly towards the interior facing, removably attachable finger grips 28. Each opposing lateral side 17 includes a protuberance 30, which is preferably planar. Each protuberance 30 extends longitudinally along at least a portion of the striker housing lateral side 17. Protuberance 30 forms a ridge or gap 19 along at least one edge, and preferably along top and bottom sides, with the corresponding striker housing lateral side 17.

Each protuberance 30 forms an attachment, such as a slidable attachment, with a complementary attachment mating structure 32 located on the interior of the corresponding finger grip 28 (the interior of the corresponding finger grip 28 being the side of the finger grip exposed to the interior of the slide when the finger grip 28 is attached to the slide 20).

Finger grip 28 is inserted within an aperture or through-hole 36 located on the lateral side 21 of slide 20 (see FIG. 2A). The complementary attachment mating structure 32 of finger grip 28 is configured to receive the planar protuberance 30 of striker housing 14.

As shown, the complementary mating structure 32 comprises at least one, and preferably more than one wedge portion 32*a,b* to slidably insert within the ridge or gap 19 along the edge(s) of the protuberance 30 and retain the protuberance 30.

These attachment components may be reversed, with the striker housing having the wedge portions and the finger grips having the protuberances. The attachment components are configured to receive slidably the striker housing once the finger grips have been placed within aperture 36 on the lateral sides of slide 20.

It should be noted that this attachment scheme is only one embodiment for attaching finger grips 28 to striker housing 14. Other embodiments of attachment are not precluded, and may include indentations and extensions on either the striker housing lateral side, on the finger grip inside surface, or both, that perform, for example, a snap-fit, a friction fit, or an interlocking attachment formed by the compression of resilient members into complementary receiving slots.

Additionally, finger grips 28 may include a resilient circumferential ridge 29 that encompasses a circumferential lip 31 around receiving aperture 36, or vice-versa, for a compression fit attachment to the slide. Ultimately, the attachment of the finger grips to the striker housing assists in controlling the up/down and side/side movement of the striker housing relative to the slide when the striker housing is in place.

Finger grips 28 are preferably resilient, having a roughened or patterned outer surface 34 for facilitating a gripping action when gripped by a user attempting to rack or pull the slide. In one embodiment, the outer surface 34 is shaped concave inwards towards the inside of slide 20 to enhance the gripping action. The patterned finger grips may resemble a similar pattern on the handle grip.

Figure 3:
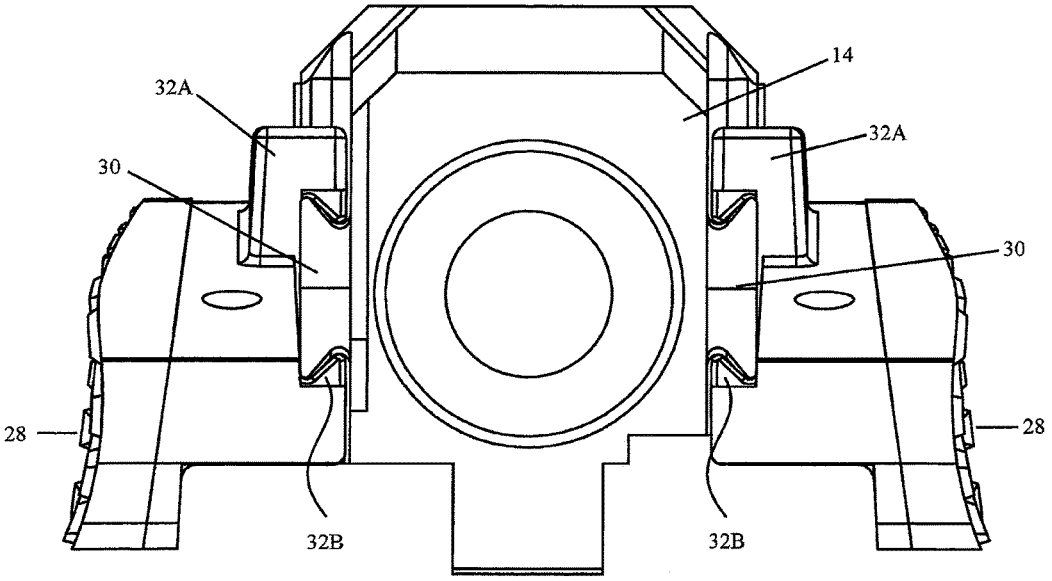
FIG. 3 is a cross-sectional view from the muzzle end of the striker housing held in place to the slide with slidably attached finger grips.

FIG. 3 is a cross-sectional view from the muzzle end of striker housing 14 to which the finger grips 28 are slidably attached in a slidable attachment scheme. As shown, the attachment ensures the secure placement of the striker housing 14, and prohibits unwarranted motion vertically (upwards or downwards) or longitudinally (side to side) in a motion with respect to the barrel axis. Once striker housing 14 is slid into place, the finger grip complementary mating structure secures the striker housing within the slide. During the racking of the slide, finger grips 28 are compressed towards the inside of the slide as part of the gripping motion, which provides an additional gripping force for the finger grips to hold the striker housing.

Figure 4:
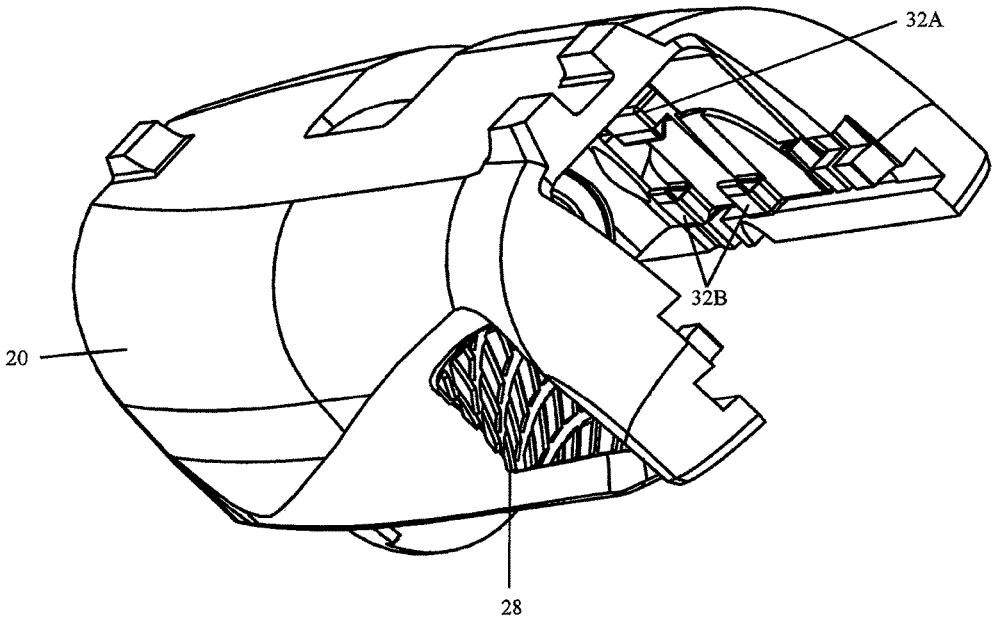
FIG. 4 is a perspective view of the pistol slide with finger grips attached for insertion of the striker housing.

FIG. 4 is a perspective view of the breech end of pistol slide 20 with finger grips 28 inserted in aperture 36 for receiving striker housing 14 (not shown). Protrusions 32*a,b* are shown extended into the interior of slide 20. Protrusions 32*a,b* receive the complementary planar protuberance 30 of striker housing 14.

Figure 5:
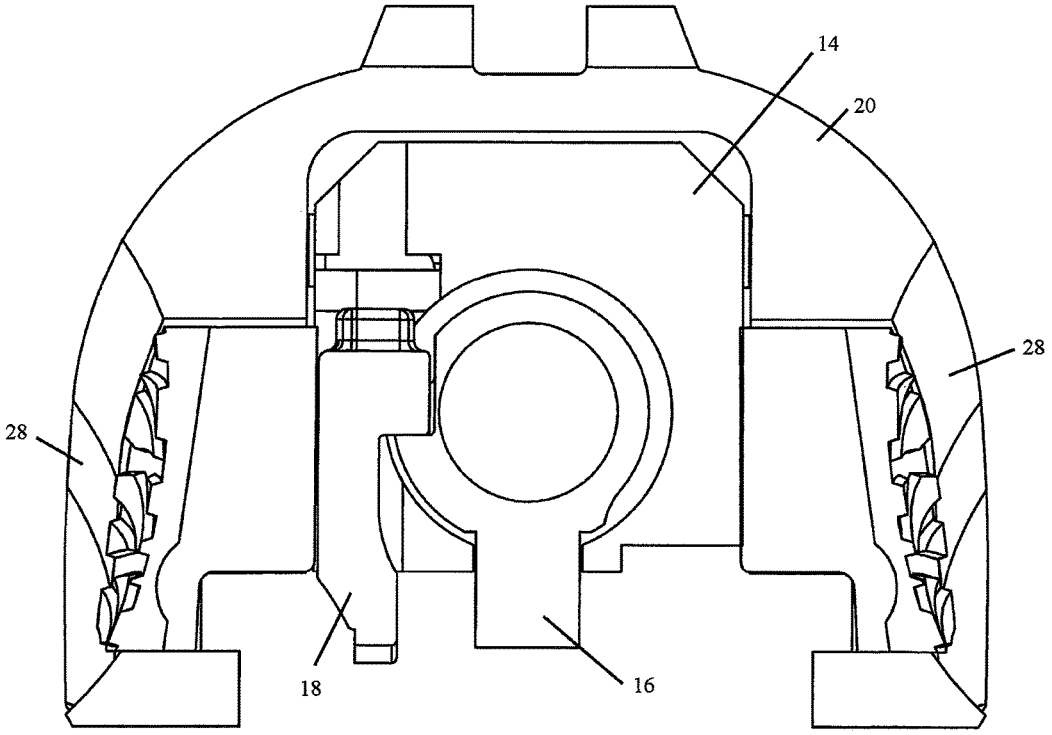
FIG. 5 is a cross-sectional view of the assembled striker housing, striker, and striker block in a pistol slide, held in place by grip inserts of the pistol slide finger grips.

FIG. 5 is a cross-sectional view of the breech end of slide 20 with assembled striker housing 14, striker 16, and striker block 18, held in place by protrusions or ridges of finger grips 28. All the intricate machining for holding the striker and striker block is present within the striker housing, thus eliminating this machining and manufacturing complexity from the interior surface of the slide.

Figure 6:
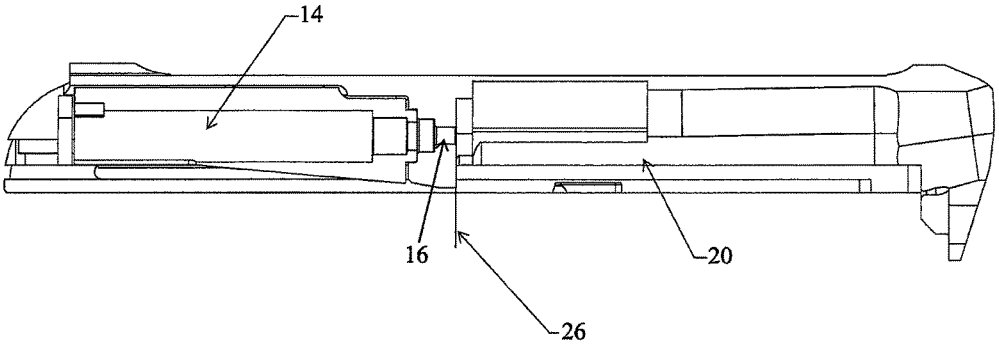
FIG. 6 depicts a cross-sectional view along the longitudinal axis of the pistol side having a striker housing, striker block, and striker secured therein.

FIG. 6 a cross-sectional view along the longitudinal axis of the pistol side 20 having a striker housing 14, striker block 18, and striker 16 secured therein. Finger grips 28 are not shown. Striker 16 is proximate breech face 26.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A firearm comprising:

a frame with a magazine receiving grip and a trigger firing mechanism;

a barrel having an internal axial bore, a breech end, a muzzle end, and a cartridge receiving aperture;

a slide having sidewalls with at least one sidewall aperture, an interior, a breech end, a muzzle end having an aperture for exposing the bore of the barrel, and a longitudinal axis parallel to the barrel, the slide enclosing at least a portion of the barrel when the firearm is in a cocked position, the slide being slidably movable along the longitudinal axis with respect to the frame;

an insertable, removable striker housing having an aft end and a forward end, and opposing lateral sides, the striker housing including a striker and a striker block responsive to the trigger firing mechanism of the firearm, the striker housing insertably held within the slide interior, such that the striker housing forward end is proximate the barrel breech end when the striker housing is installed in the slide, said striker housing mounted to said slide sidewall through said at least one sidewall aperture.

2. A firearm comprising:

a frame with a magazine receiving grip and a trigger firing mechanism;

a barrel having an internal axial bore, a breech end, a muzzle end, and a cartridge receiving aperture;

a slide having an interior, a breech end, a muzzle end having an aperture for exposing the bore of the barrel, and a longitudinal axis parallel to the barrel, the slide enclosing at least a portion of the barrel when the firearm is in a cocked position, the slide being slidably movable along the longitudinal axis with respect to the frame;

an insertable, removable striker housing having an aft end and a forward end, and opposing lateral sides, the striker housing including a striker and a striker block responsive to the trigger firing mechanism of the firearm, the striker housing insertably held within the slide interior, such that the striker housing forward end is proximate the barrel breech end when the striker housing is installed in the slide, wherein the slide has opposing lateral sides parallel, and adjacent, to the striker housing opposing lateral sides, wherein at least one of the slide's opposing lateral sides includes an aperture or through-hole, and at least one of said striker housing opposing lateral sides includes a mating structure, each for receiving a removable finger grip.

3. The firearm of claim 2, wherein the finger grip includes a resilient circumferential ridge that encompasses a circumferential lip around the opposing lateral side aperture or through-hole, or vice-versa, for a compression fit attachment to the slide.

4. A firearm comprising:

a frame with a magazine receiving grip and a trigger firing mechanism;

a barrel having an internal axial bore, a breech end, a muzzle end, and a cartridge receiving aperture;

a slide having an interior, a breech end, a muzzle end having an aperture for exposing the bore of the barrel, and a longitudinal axis parallel to the barrel, the slide enclosing at least a portion of the barrel when the firearm is in a cocked position, the slide being slidably movable along the longitudinal axis with respect to the frame;

an insertable, removable striker housing having an aft end and a forward end, and opposing lateral sides, the striker housing including a striker and a striker block responsive to the trigger firing mechanism of the firearm, the striker housing insertably held within the slide interior, such that the striker housing forward end is proximate the barrel breech end when the striker housing is installed in the slide;

wherein the slide has opposing lateral sides parallel, and adjacent, to the striker housing opposing lateral sides, wherein at least one of the slide's opposing lateral sides includes an aperture or through-hole for receiving a removable finger grip; and wherein the striker housing includes a first attachment member on at least one of the striker housing opposing lateral sides for securing to a complementary second attachment member on a corresponding removable finger grip when the striker housing is inserted within the slide, and the corresponding removable finger grip is inserted within the aperture or through-hole of an adjacent lateral side of the slide.

5. The firearm of claim 4 wherein the first attachment member on the striker housing comprises a planar protuberance on the at least one striker housing opposing lateral side, extending longitudinally along the at least one striker housing opposing lateral side, and forming a ridge or gap along at least one edge with the at least one striker housing opposing lateral side.

6. The firearm of claim 5 wherein the second attachment member is configured to receive the planar protuberance, comprising at least one wedge portion to slidably insert within the ridge or gap formed on the planar protuberance of the striker housing.

7. The firearm of claim 4, wherein an attachment member includes an indentation and/or and extension on either the striker housing lateral side, on the finger grip inside surface, or both, to perform a snap-fit, a friction fit, or an interlocking attachment formed by the compression of resilient members into complementary receiving slots.

8. A pistol comprising:

a frame having a front end, a rear end, laterally spaced side walls, a hand grip with a chamber therein for receiving a magazine, a firing mechanism fitted into the frame, a barrel having a breech end and a muzzle end, and a slide having an apertured front wall, a rear wall, laterally spaced side walls disposed in vertically spaced relation to the frame, each of the slide's laterally spaced side walls having an aperture for receiving a detachable finger grip;

an insertable, detachable striker housing having an aft end and a forward end, and opposing lateral sides, the striker housing retaining a striker and a striker block, the striker housing insertably held within the slide, such that the striker housing forward end is proximate the breech end of the barrel;

each of the slide's laterally spaced side walls includes an aperture or through-hole for receiving the detachable finger grip; and the striker housing includes a first attachment member on each of the striker housing's opposing lateral sides for securing to a complementary second attachment member on each corresponding detachable finger grip when the striker housing is inserted within the slide, and each corresponding detachable finger grip is inserted within the aperture or through-hole of the adjacent laterally spaced sidewall of the slide.

9. The pistol of claim 8 wherein:

the first attachment member on the striker housing comprises a planar protuberance on each striker housing opposing lateral side, extending longitudinally along the striker housing opposing lateral side, and forming a ridge or gap; and the second attachment member is configured to receive the planar protuberance, comprising at least one wedge portion to slidably insert within the ridge or gap formed on the planar protuberance.

10. The pistol of claim 8 wherein:

the first attachment member on the striker housing comprises at least one wedge portion to slidably insert within a ridge or gap formed on a planar protuberance of a corresponding finger grip; and the second attachment member on the finger grip including the planar protuberance extending longitudinally along the striker housing opposing lateral side, and forming the ridge or gap.

11. The pistol of claim 8 wherein the finger grips comprise a resilient material, having a roughened or patterned outer surface for facilitating a gripping action when gripped by a user attempting to rack or pull the slide.

* * * * *